US005632368A

United States Patent [19]

Moncrief

[11] Patent Number: 5,632,368

[45] Date of Patent: May 27, 1997

[54] OPTIMUM CARTON HOLD-DOWN ELEMENT FOR ROTARY FEEDERS

[75] Inventor: Frank Moncrief, Acworth, Ga.

[73] Assignee: Riverwood International Corporation, Atlanta, Ga.

[21] Appl. No.: 426,333

[22] Filed: Apr. 21, 1995

[51] Int. Cl.[6] ..... B31B 5/80

[52] U.S. Cl. ..... 198/471.1; 53/564; 493/315; 414/786; 414/797.8

[58] Field of Search ..... 198/471.1; 53/250, 53/251, 381.1; 414/786, 797.8; 493/309, 313, 315, 316, 317, 318, 417; 271/3.11, 5, 11, 12, 3.07, 107, 90, 99, 264

[56] References Cited

U.S. PATENT DOCUMENTS

| | | | |
|---|---|---|---|
| 2,601,481 | 6/1952 | Williams | 493/315 |
| 3,534,667 | 10/1970 | Krause | 493/316 X |
| 4,057,008 | 11/1977 | Hughes | 493/313 X |
| 5,102,385 | 4/1992 | Calvert | 493/417 X |
| 5,426,920 | 6/1995 | Quadalti | 53/564 |
| 5,454,215 | 10/1995 | Martelli | 53/564 |

*Primary Examiner*—Frank E. Werner
*Attorney, Agent, or Firm*—Isaf, Vaughan & Kerr

[57] ABSTRACT

A hold-down element for a rotary feeder has a curved elongated member for continuously contacting an article during rotation of a rotary head. The curvature of the hold-down element is selected so that the distance from the elongated member to the rotary head increases from the point of initial contact to the final contact point on the elongated member. The hold-down element preferably maintains contact for at least 20° of rotation of the rotary head, and thus maintains contact with the article for an extended period of time. The hold-down element is attached to a vacuum shaft on the rotary head, and is prevented from rotating relative to the vacuum shaft by a keyway on the hold-down element and a key on the vacuum shaft. The hold-down element, however, is permitted to travel transversely along a longitudinal axis of the vacuum shaft in order to accommodate different shaped articles.

20 Claims, 5 Drawing Sheets

OPTIMUM CARTON HOLD-DOWN ELEMENT FOR ROTARY FEEDERS

FIELD OF THE INVENTION

This invention generally relates to an element for holding down an article as the article is being released by a retaining means, such as a vacuum element. The invention is particularly suited for use in an apparatus, such as a rotary carton feeder, which delivers cartons to a packaging machine. More specifically, this invention concerns a hold-down element for maintaining a carton in an erect position as the carton is placed onto a conveyor system.

BACKGROUND OF THE INVENTION

With reference to FIGS. 1 and 2, which depict an arrangement of the prior art, a rotary feeder (not shown) picks up a collapsed paperboard carton 8 with vacuum cups 10, at least partially erects the carton 8 using centrifugal force, and places the carton 8 between flights 12 where the carton is fully erected. The flights 12 move the open carton 8 in a downstream direction, indicated by the arrow, where the carton 8 is filled with cans, bottles, or other type of product. A rail or ski 14, which is positioned slightly downstream from the rotary feeder, maintains the carton 8 in an erect position after the vacuum cups 10 release the carton. The carton thereafter moves underneath the ski 14 to a carton loading assembly of the packaging system. The ski 14 must be carefully placed to not interfere with the erection of the carton 8, yet still be close enough to hold down the carton after it has been released from the vacuum cups 10. If the ski 14 is positioned too far away from the carton 8, the carton 8 may partially collapse before reaching the ski 14, and push itself out of the pocket created between successive lugs or flights 12. On the other hand, if the ski 14 is positioned too close to the carton 8, the carton 8 will not be erected due to the carton 8 colliding with the ski 14. It was therefore difficult in the industry to place the ski 14 in its optimal position.

FIGS. 3 and 4 also show such a prior art arrangement. FIG. 3 shows a typical overhead rotary feeder head 20 comprising a stationary central sun gear 22, an idler gear 24, and an outer planetary gear 26. The rotary head 20 rotates in a counterclockwise rotation about a central axis 30, while the vacuum cups 10, which are attached to elements (not shown) driven by the outer planetary gear 26, rotate in a clockwise direction with the outer planetary gear 26. A J-hook 28 also is attached to the outer planetary gear 26 and makes momentary contact with the upper surface of each carton 8 as the vacuum cups 10 release the carton 8. FIG. 4 is a graphical, cycloid profile showing a variation of the distance from the J-hook 28 to the carton 8 over time. As shown in FIG. 4, the J-hook 28 makes only momentary contact with the carton 8 for each rotation of the outer planetary gear 26. Since the J-hook 28 holds the carton 8 down while the vacuum cups 10 release the carton 8, the rail or ski 14 may be placed slightly further downstream. Thus, the placement of the ski 14 is not as critical with the use of the J-hook 28.

The J-hooks 28 are attached above the vacuum cups 10 on a vacuum stem 9, and in the prior art, had to be precisely located on the vacuum stem 9 in order to make only momentary contact with the carton 8. If the J-hooks 28 were located too high on the vacuum stem 9, the J-hooks 28 would not make any contact with the carton, and the carton 8 would be left free to collapse. Conversely, if the J-hooks 28 were located too low on the vacuum stem 9, the J-hooks 28 would extend below the top surface of the carton 8 and would exert force into the upper surface of the carton 8. In addition to being difficult to properly adjust, the J-hooks 28 frequently moved out of position during the operation of the rotary head 20. Once the J-hooks 28 have been moved out of position, the J-hooks often come in contact with surrounding parts of the packaging machine, thereby damaging those parts.

It was therefore difficult in the industry to erect a carton 8 in such machines, and maintain the carton in its erect position as the carton moved in a downstream direction. It also was difficult in the prior art to hold down the carton 8 for various configurations of the vacuum cups 10. Previously, when the rotary feeder was adjusted for a different shaped carton, the vacuum cups would be placed at different positions on the carton, thereby requiring the J-hooks to be repositioned as well. Since the positioning of the J-hooks 28 is difficult, the process of adjusting the rotary feeder to accommodate a different carton is also difficult. Also, because of the time wasted in placing the ski 14 or the J-hooks 28 in their proper position, the rotary feeders became inefficient.

SUMMARY OF THE INVENTION

The invention comprises an improved hold-down element for use with a rotary feeder. The hold-down element is attached to the rotary feeder and has an elongated member with a curved outer surface. The curvature of the outer surface is defined so that a distance from the outer surface to the central axis of the rotary feeder increases from one end of the elongated member to the other, opposite end of the elongated member. This distance preferably continuously increases, so that a smooth arc is defined in the outer surface of the hold-down element. The elongated member maintains constant contact with the article during rotation of the rotary feeder, and consequently holds the article down during the rotation of the rotary feeder for an extended period of time.

Preferably, the hold-down element is attached to a vacuum shaft on the rotary feeder by forming a keyway on the hold-down element which mates with a key formed on the vacuum shaft. When the hold-down element is attached in such a manner, the hold-down element cannot rotate out of alignment, but is allowed to slide along the axis of the vacuum shaft in order to accommodate for various shapes of articles. Also, the hold-down element preferably contacts the article for at least 20° of rotation of the rotary head in order to maintain contact for an extended period of time. The hold-down element of the invention may be used on a conventional, overhead rotary feeder having a rotary head and one or more suction cups for picking up and releasing an article. The outer surface of the hold-down element also may form a circular arc about a center point located above and to the side of the vacuum shaft.

Another aspect of the invention relates to a method for feeding an article from one location to a second location. The method comprises the steps of picking up an article with a rotary feeder at a first location, moving the article to a second location, and releasing the article at the second location. The method further comprises the step of rolling an elongated member, connected to the rotary head, across a surface of the article while the article is being released from the rotary feeder. As a result of the method, the article is held down during rotation of the rotary feeder for an extended period of time.

Preferably, the elongated member is rolled over the article for at least 20° of rotation for the rotary head so that the article is held down for as long as possible. Also, the hold-down element preferably makes initial contact with the article prior to the release of the article to maintain continuous contact with the article. When the article consists of a carton, the method of the invention holds the carton down from the time the carton is released by the suction cups until the time the carton travels underneath a hold-down rail or ski.

DETAILED DESCRIPTION OF THE PREFERRED EMBODIMENTS

Figure 1:
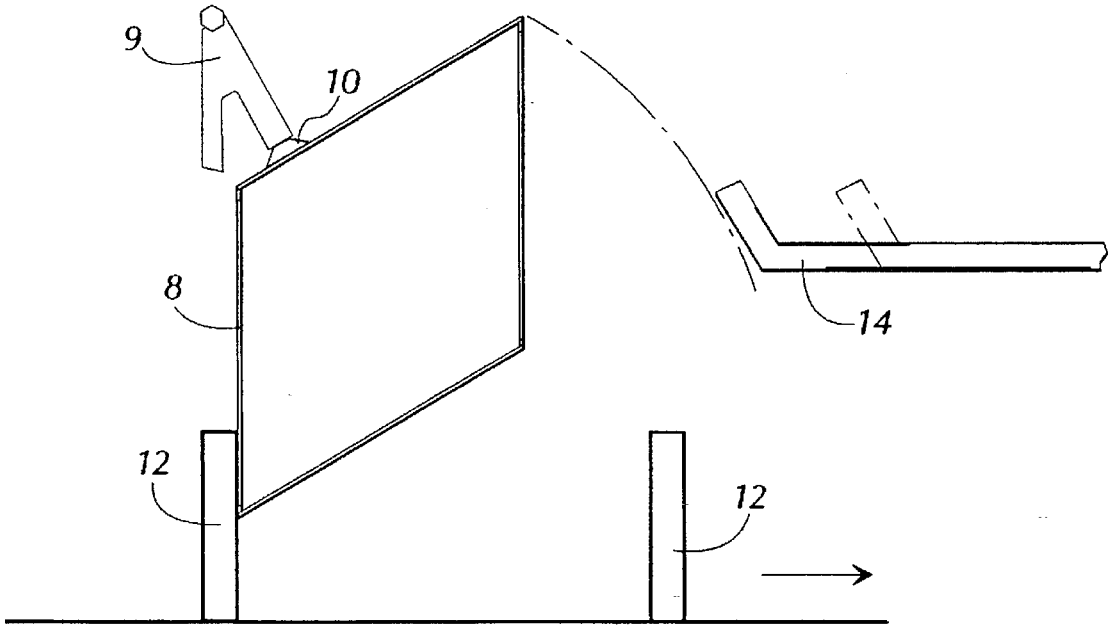
(PRIOR ART) FIG. 1
FIG. 1 is a side view of a carton in the process of being erected by a conventional rotary head.
Figure 2:
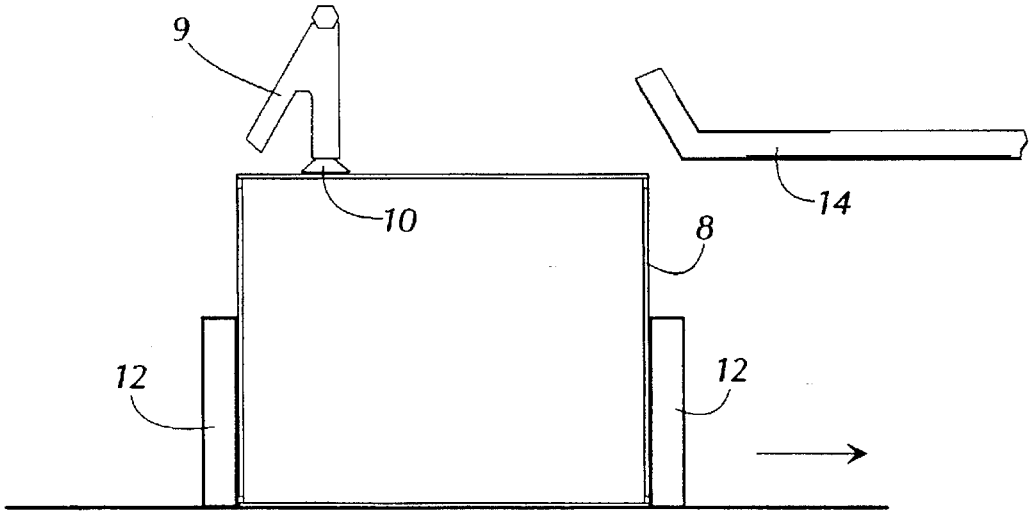
(PRIOR ART) FIG. 2
FIG. 2 is a side view of a carton in its fully erected position.
Figure 3:
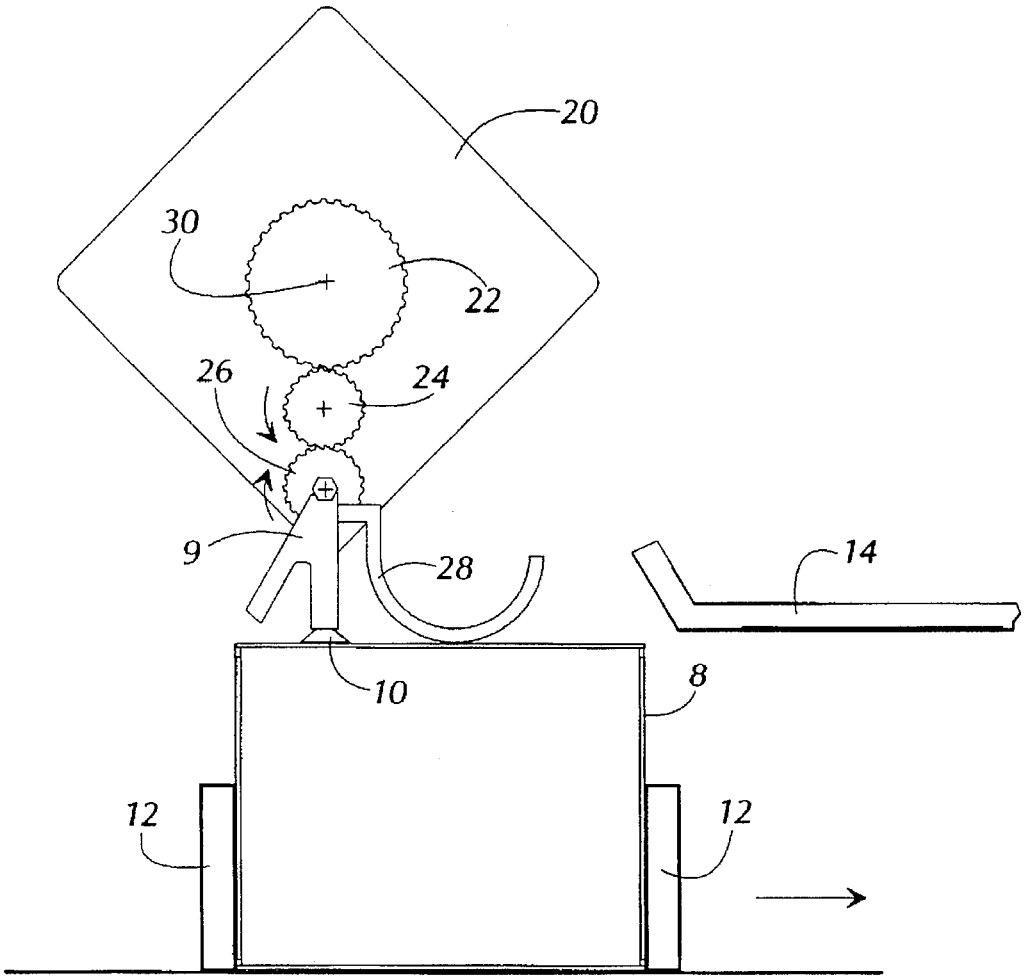
(PRIOR ART) FIG. 3
FIG. 3 is a side view of a rotary head with a conventional J-hook hold-down element.
Figure 4:
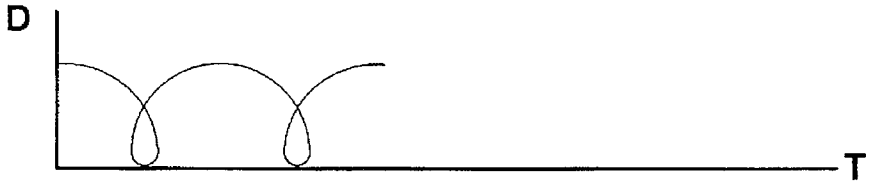
(PRIOR ART) FIG. 4
FIG. 4 is a graphical, cycloid profile showing the distance from the J-hook to the carton during operation of the rotary head.
Figure 5:
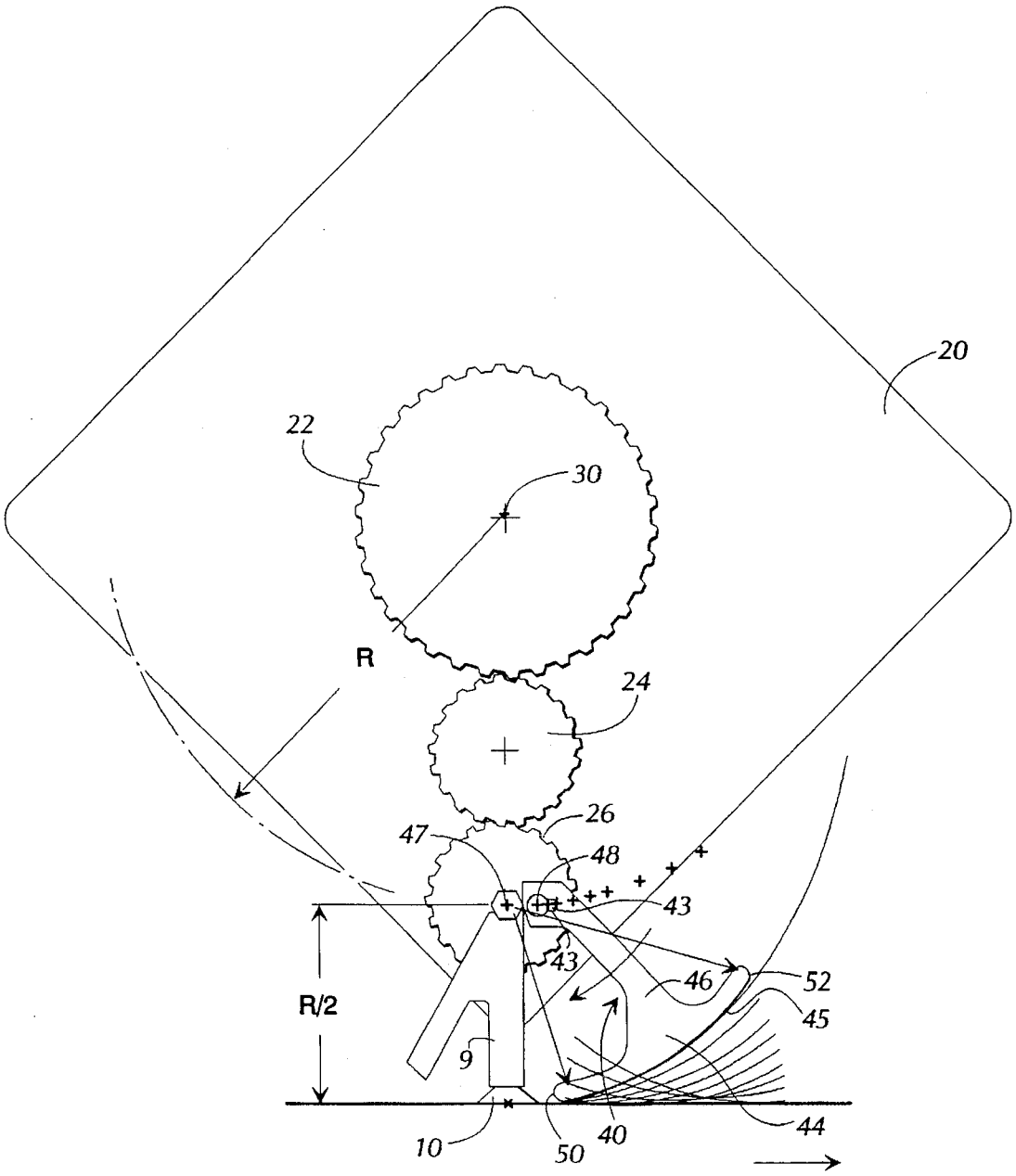
FIG. 5 is a side view of a hold-down element for a rotary feeder according to a first embodiment of the invention.

FIG. 5 shows a rotary head 20 of a carton feeder assembly, with a hold-down element 40 according to one embodiment of the invention. In the example shown, the hold-down element 40 is placed on a 4-stop rotary head 20 rotating in a counter-clockwise direction. In general, if the distance from a transverse centerline or rotating axis 30 of the rotary head 20 to the center of an outer planetary gear 26 is equal to R, then the length of a vacuum stem 9 having a vacuum cup 10 preferably should be dimensioned approximately to equal one-half R. In operation, the vacuum stem 9 and the hold-down element 40 rotate in a clockwise direction at about three times the speed of the rotary head 20.

The hold-down element 40 is attached to a transverse vacuum shaft 48 on the rotary head 20, and generally comprises a structural section 46 and an elongated section 44. The structural section 46 is connected at one end to the vacuum shaft 48 and has the other end connected to the elongated section 44. The structural section 46 places the elongated section 44 into a position where an outer curved surface 45 of the elongated section 44 maintains continuous contact with a carton 8 during a specific operational phase of the rotary head 20.

Figure 6A:
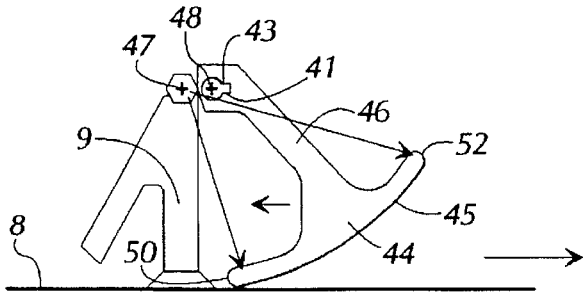
FIGS. 6(A) through 6(E) are side views of the hold-down element for different angles of rotation of the vacuum shaft.
Figure 6B:
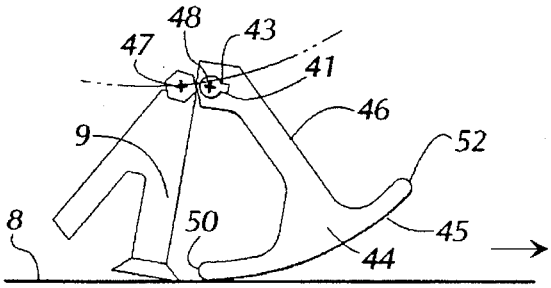

During operation of the hold-down element 40, the outer surface of the elongated section 44 preferably maintains contact with the carton 8 for at least 20° of rotation of the rotary head 20. With reference first to FIG. 6(A), when the rotary head 20 is at a point in its rotation defined to be at an angle of 0°, the vacuum cup 10 has erected the carton 8, has placed the carton 8 between flights 12, and is still attached to the carton 8. When the rotary head 20 has rotated to an angle of 5°, as shown in FIG. 6(B), the vacuum in vacuum cup 10 has been vented, thereby releasing the carton 8. At this point, a first end 50 of the elongated portion 44 along outer surface 45 is making contact with the carton 8. While the elongated section 44 contacts carton 8, the specific portion of section 44 which makes this contact is outer surface 45. The first end 50 of the elongated portion 44 preferably makes initial contact with the carton 8 prior to the release of the carton 8 from the vacuum cup 10, in order to eliminate any period of time in which the carton 8 is left free to collapse.

Figure 6D:
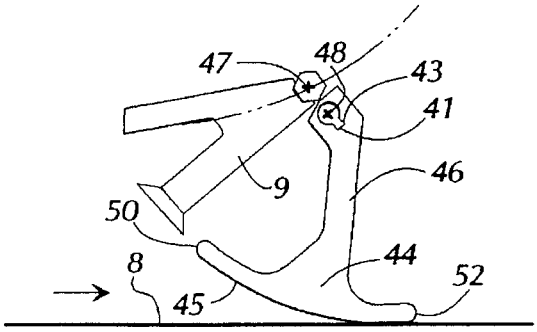
Figure 6C:
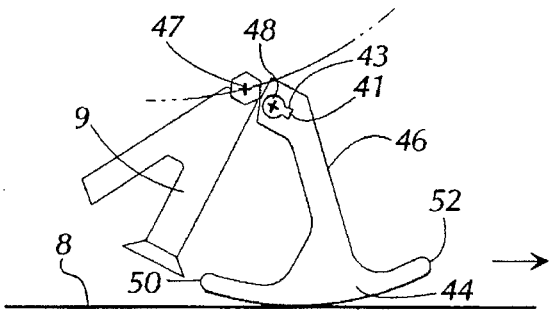
Figure 6E:
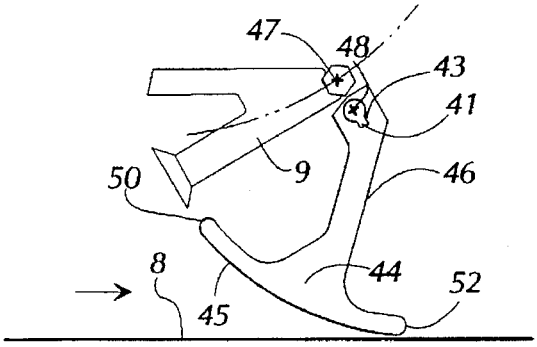

As the rotary head 20 continues to rotate, the outer surface 45 of hold-down element 40 maintains constant contact with the carton 8 to prevent the carton 8 from collapsing. Thus, as shown in FIGS. 6(C) and 6(D) at respective rotary head 20 angles of 15° and 25°, the hold-down element 40 is still in contact with the carton 8. When the rotary head 20 has rotated approximately to an angle of 30°, as shown in FIG. 6(E), the hold-down element 40 disengages or releases contact with the carton 8. At this point in time, the carton 8 has been fed underneath the rail 14, or has been engaged by some other structure or assembly.

As shown in FIGS. 6(A) through 6(E), the hold-down element 40 maintains the carton 8 in its erect position for a period of time as the carton 8 moves in the downstream position. The hold-down element 40 therefore can maintain the carton 8 in its erect position from the time when the vacuum cups 10 release the carton 8 up until the time when the carton 8 is beneath the rail or ski 14. Since the outer surface 45 of hold-down element 40 maintains contact with the carton 8 for this period of time and does not just make momentary contact with the carton 8, the ski 14 is more easily placed into its proper position relative to the rotary head 20.

The hold-down element 40 also is easily maintained in a proper position with respect to the vacuum cups 10. A key 41 can be soldered onto the vacuum shaft 48 and a keyway 43 is manufactured into the hold-down element 40. The hold-down element 40 is then mounted to the vacuum shaft 48 by mating the key 41 on the vacuum shaft 48 with the keyway 43 in the hold-down element 40. The key 41 and keyway 43 prevent the hold-down element 40 from rotating out of alignment during operation of the rotary feeder.

In an alternate embodiment, the hold-down element 40 is attached directly to a hex shaft 47 upon which the vacuum stem 9 is attached. In this embodiment, the hold-down element 40 has a hexagon-shaped opening for mating with the hexagon-shaped shaft 47. The hold-down element 40 can therefore move along the axis of the hex shaft 47 but is unable to rotate out of alignment about the hex shaft 47. The rotary feeder can be adjusted easily for different carton shapes by simply sliding the hold-down element 40 along the outer surface of hex shaft 47.

Figure 7:
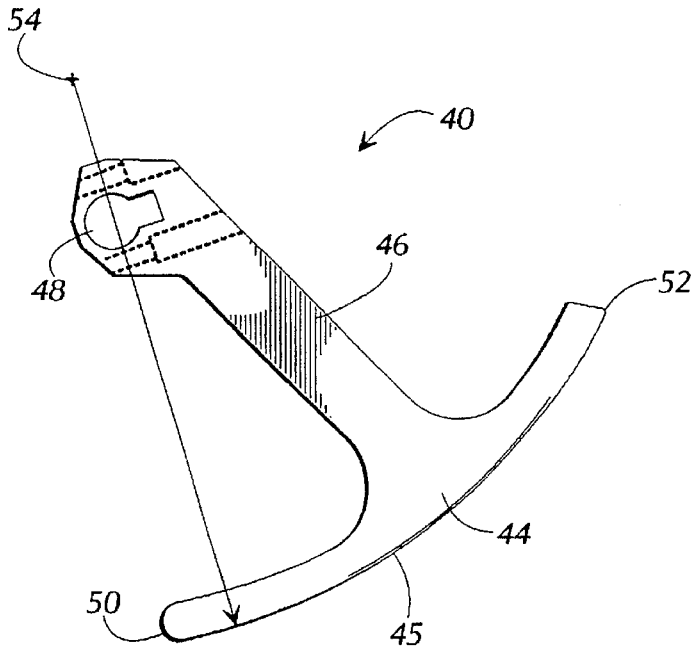
FIG. 7 is an example of a hold-down element for a 12 inch diameter rotary feeder.

FIG. 7 shows an example of a hold-down element 40 for a 12 inch diameter rotary feeder. The direction of the rotary feeder is determined by the linear distance from the axis of the sun gear to the axis of the outermost planetary gear. As is apparent from the figure, a first end 50 of the elongated element 44 is at a closer distance to the vacuum shaft 48 than the second or other end 52 of the elongated section 44. The outer surface 45 of the elongated section 44 does not form a circular arc about the vacuum shaft 48, but rather forms a circular arc about a center point 54. The center point 54 is located approximately 2.567 inches above and approximately 0.457 inches to the left side of the axis of vacuum shaft 48. The center point 54 is at a location such that the elongated section 44, or more specifically, the outer surface 45 of the hold-down element 40, maintains continuous contact with the carton 8 during a specific phase of rotation of the rotary head 20. In the example shown in FIG. 7, the outer surface 45 of the elongated section 44 is at a approximately 8.521 inches from the center point 54. The other dimensions of the hold-down element 40 are not critical to the operation of the hold-down element 40 and will therefore not be discussed in detail.

Figure 8:
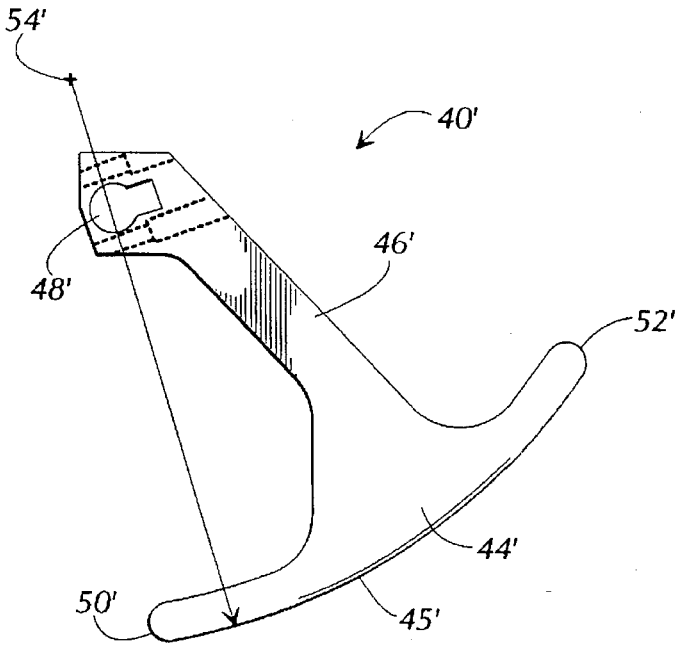
FIG. 8 is an example of a hold-down element for a 14 inch rotary feeder.

An example of a hold-down element 40' for a 14 inch rotary feeder is depicted in FIG. 8. As with the example shown in FIG. 7, the outer surface 45' of the elongated section 44' has a first end 50' located closer to the vacuum shaft than a second end 52'. The outer surface of the elongated section 44' forms a circular arc about a center point 54' located approximately 2.092 inches above and approximately 0.213 inches to the left side of the axis of vacuum shaft 48. The distance from the center point to the outer surface of elongated member is approximately 9.829 inches.

While the hold-down element 40 is attached to a 4-stop rotary head, the hold-down element 40 may be attached to other types of rotary heads, such as a 3-stop rotary head. Additionally, the dimensions of the hold-down element 40 are not limited to just a 12 inch rotary head or a 14 inch rotary head but rather can be altered to suit any size rotary head. The dimensions of a hold-down element 40 for other rotary heads or for other applications will be apparent to those of ordinary skill in the art. While the shape of the outer surface 45 of elongated section 44 preferably forms a continuous curve, this shape is not absolute as long as there exists a substantially continuous outer curved surface to make contact with carton 8. Further, while the article being held down has been described as a carton, the hold-down element 40 of the invention may be used to hold-down other types of articles, such as coupons.

It will further be obvious to those skilled in the art that many variations may be made in the above embodiments, here chosen for the purpose of illustrating the present invention, and full result may be had to the doctrine of equivalents without departing from the scope of the present invention, as defined by the appended claims.

What is claimed is:

1. A hold-down element for use with a rotary feeder rotating about a central axis, wherein the rotary feeder rotates and expands an expandable article from a first location above a flight conveyor to a second location in a fully expanded state between upstanding lugs on the conveyor and wherein said feeder and conveyor move in opposite directions, said hold-down element for holding down and securing the expanded article against the conveyor between the lugs after the expanded article has been released by the rotary feeder at the second location, said hold-down element comprising:

an elongated member adapted to maintain contact with the expanded article in the second position;

spacing means having a first end attached to the rotary feeder and a second end attached to said elongated member for spacing said elongated member from the rotary feeder, wherein the rotary feeder imparts a rotational motion to said spacing means and said elongated member;

said elongated member having a continuously curved outer surface so that a distance from said outer surface to said rotary feeder continuously increases from one end of said elongated member to an opposite end of said elongated member; and wherein said elongated member of said hold-down element maintains constant contact with a surface of the article during rotation of said rotary feeder, such that the article surface remains tangent to said continuously curved surface, such that said continuously curved surface consequently holds the article down during said rotation of said rotary feeder, whereby said rotary feeder smoothly disengages from the article surface without dislodging the article from the flight conveyor.

2. The hold-down element as set forth in claim 1, wherein said spacing means attaches said elongated member to a vacuum shaft on said rotary feeder.

3. The hold-down element as set forth in claim 2, wherein said outer surface of said elongated member is curved to form a circular arc about a center point located above and to a side of said vacuum shaft.

4. The hold-down element as set forth in claim 2, further comprising a key on said vacuum shaft and a keyway on said spacing means and wherein said key and said keyway prevent said elongated member from rotating about said vacuum shaft.

5. The hold-down element as set forth in claim 2, wherein said spacing means attaches said elongated member to said vacuum shaft to permit movement of said elongated member along a longitudinal axis of said vacuum shaft.

6. The hold-down element as set forth in claim 1, wherein said outer surface of said elongated member constantly contacts the article for more than 20° of rotation of said rotary feeder.

7. The hold-down element as set forth in claim 1, wherein said outer surface of said elongated member is curved such that said elongated member contacts the article before said article has been released at said second location.

8. A rotary feeder adapted to receive an expandable article from a first position, expand the article and place the expanded article in a second position on a flight conveyor between upstanding lugs thereon and wherein said feeder and conveyor move in opposite directions, said rotary feeder comprising:

a rotary head for rotating about a central axis;

a suction cup connected to said rotary head for engaging an article surface and for moving the article from the first location to the second location and for releasing the article in an expanded state at the second location;

a hold-down element, connected to said rotary head, comprising an elongated member and a structural member having one end connected to said rotary head and an opposite end connected to said elongated member, said elongated member having a continuously curved outer surface so that a distance from said outer surface to said rotary feeder increases from one end of said elongated member to an opposite end of said elongated member;

wherein said continuously curved surface of said elongated member of said hold-down element rolls over and maintains constant contact with a surface of the article during rotation of said rotary feeder, such that the article surface remains tangent to said continuously curved surface, such that continuously curved surface consequently holds the article down during said rotation of said rotary feeder, whereby said suction cup smoothly disengages from the article surface without dislodging the article from the flight conveyor.

9. The rotary feeder as set forth in claim 8, wherein said one end of said structural member is connected to a vacuum shaft on said rotary head.

10. The rotary feeder as set forth in claim 9, wherein said outer surface of said elongated member is curved to form a circular arc about a center point located above and to a side of said vacuum shaft.

11. The rotary feeder as set forth in claim 9, further comprising a key on said vacuum shaft and a keyway on said structural member and wherein said key and said keyway prevent said structural member from rotating about said vacuum shaft.

12. The rotary feeder as set forth in claim 9, wherein said structural member attaches said elongated member to said vacuum shaft to permit movement of said structural member and said elongated member along a longitudinal axis of said vacuum shaft.

13. The rotary feeder as set forth in claim 9, wherein said outer surface of said elongated member is curved such that said elongated member contacts the article before the article has been released at said second location.

14. The rotary feeder as set forth in claim 8, wherein said outer surface of said elongated member constantly contacts said article for more than 20° of rotation of said rotary feeder.

15. The hold-down element as set forth in claim 8 wherein:

said structural member is rotatingly connected to said rotary feeder near an outer periphery thereof for allowing said structural member and said elongated surface to rotate relative to said rotary feeder between the first and second positions, thereby facilitating said rolling of said continuously curved outer surface across the article.

16. The rotary feeder as set forth in claim 8 wherein:

said spacing means is rotatingly connected to the rotary head near an outer periphery thereof for allowing said structural member and said elongated member to rotate relative to the rotary head between the first and second positions, thereby facilitating said rolling of said continuously curved outer surface across the article surface.

17. A method for holding down an expandable article on a flight conveyor between upstanding lugs as the article is being sequentially fed and expanded by a rotary feeder and wherein said feeder and conveyor move in opposite directions, comprising the steps of:

(a) picking up the article with said rotary feeder at a first location;

(b) moving the article with said rotary feeder to a second location;

(c) releasing the article at said second location; and (d) rolling an elongated member having a continuously curved outer surface, connected to said rotary head, across a surface of the article while the article is being released, such that the article surface remains tangent to said curved outer surface, thereby holding the article down on said conveyor between said upstanding lugs during rotation of said rotary feeder, without dislodging the article from the flight conveyor.

18. The method as set forth in claim 17, wherein said step of rolling said elongated member across the article surface comprises the step of maintaining contact between said elongated member and the article for more than 20° of rotation of said rotary head.

19. The method as set forth in claim 17, further comprising the step of adjusting said elongated member for a different shaped article by moving said elongated member in a direction parallel to an axis of rotation of said rotary head.

20. The method as set forth in claim 17, wherein said step of rolling said elongated member occurs before said step of releasing said article.

* * * * *